US007275407B2

(12) United States Patent
Ginsberg et al.

(10) Patent No.: US 7,275,407 B2
(45) Date of Patent: Oct. 2, 2007

(54) PROCESS FOR PRODUCING ROTATIONALLY SYMMETRICAL COMPONENTS

(75) Inventors: Jochen Ginsberg, Siegen (DE); Thomas Muhr, Attendorn (DE)

(73) Assignee: Muhr und Bender, Attendorn (DE)

( * ) Notice: Subject to any disclaimer, the term of this patent is extended or adjusted under 35 U.S.C. 154(b) by 0 days.

(21) Appl. No.: 10/131,138

(22) Filed: Apr. 25, 2002

(65) Prior Publication Data

US 2002/0160844 A1 Oct. 31, 2002

(30) Foreign Application Priority Data

Apr. 25, 2001 (DE) ..... 101 20 392

(51) Int. Cl.
*B21J 5/08* (2006.01)
*B21D 41/04* (2006.01)

(52) U.S. Cl. ..... 72/318; 72/402; 72/370.03; 72/370.04

(58) Field of Classification Search ..... 72/318, 72/402, 370.03, 370.04, 370.15, 370.1, 316, 72/356, 370.13
See application file for complete search history.

(56) References Cited

U.S. PATENT DOCUMENTS 2,054,244 A * 9/1936 Criley ..... 72/255
2,133,091 A 10/1938 Getting
2,256,065 A * 9/1941 Urschel et al. ..... 295/36.1
3,564,896 A * 2/1971 Clark ..... 72/368
3,585,832 A * 6/1971 Hinshaw et al. ..... 72/256
3,668,918 A * 6/1972 Benteler et al. ..... 72/364
4,192,167 A * 3/1980 Huebner et al. ..... 72/356
4,380,480 A 4/1983 Defino et al.
4,845,972 A * 7/1989 Takeuchi et al. ..... 72/370.03

FOREIGN PATENT DOCUMENTS

DE 1 804 673 A 6/1970
DE 31 42 480 A1 7/1982
DE 198 18 653 A1 10/1999
GB 2 092 041 A 12/1981

* cited by examiner

*Primary Examiner*—Daniel C Crane
(74) *Attorney, Agent, or Firm*—David S. Safran

(57) ABSTRACT

A process for producing a hollow monoblock shaft from a pipe, the pipe initially having a constant diameter and a constant wall thickness, and the monoblock component including at least one area of its length being of a smaller outside diameter and a greater wall thickness than the constant diameter and constant wall thickness of the pipe. The process can be carried out simply and economically by the following process steps:

selecting a pipe with a wall thickness which corresponds to the smallest wall thickness of the finished component, partial heating of at least one area of the pipe, axial upsetting the heated area of the pipe and radial forging the heated area of the pipe.

3 Claims, 2 Drawing Sheets

2
2'
4
4
$D_1$
$d_1$
$D_2$
$d_2$
$D_2$
$d_2$
$D_M$
$d_M$
$D_M$
$D_E$
$d_E$
1
3
$L_1$
(Prior Art)

PROCESS FOR PRODUCING ROTATIONALLY SYMMETRICAL COMPONENTS

BACKGROUND OF THE INVENTION

1. Field of the Invention

The invention relates to a process for producing rotationally symmetrical components from a pipe, especially hollow monoblock shafts, the pipe initially having a constant outside diameter and a constant wall thickness, and the rotationally symmetrical component having at least over one area of its entire length an outside diameter which deviates from the constant outside diameter, especially as a smaller outside diameter, and/or a wall thickness which deviates from the constant wall thickness, especially as a greater wall thickness. In addition, the invention relates to a rotationally symmetrical component.

2. Description of Related Art

Rotationally symmetrical components which have different outside diameters and different wall thicknesses over their entire length are used especially in motor vehicles as drive shafts, camshafts, intermediate shafts or gear shafts. Under the aspect of "weight reduction" which is generally becoming more and more important, shafts produced from pipes, so-called hollow shafts, have been used for some time instead of shafts produced from solid bars. There are basically two different types of pipes each of which differ in their production process. Pipes, especially steel pipes, are produced either in a seamless version, i.e., from a solid material without a lengthwise seam, or in a welded version, i.e. from bent sheet metal or steel strip with a lengthwise seam. For rotating components generally welded pipes are used since seamless pipes require concentricity that is not always reliably ensured. In addition, production of seamless pipes is generally more expensive than production of welded pipes.

In order to produce the aforementioned rotationally symmetrical components with different outside diameters and wall thicknesses, at least theoretically there is the possibility of joining several pipes, each having a constant outside diameter and constant wall thickness, into a composite pipe with the desired outside diameter and wall thickness variation. These pipes composed of several individual pipes however generally do not meet the high mechanical requirements imposed on shafts in operation.

Therefore in the prior art, especially in motor vehicles, only monoblock shafts are used, i.e., those shafts which are made from a single piece, in this case from a single pipe. The shaft is generally produced from the pipe using the so-called rotary swaging process at room temperature. Generally, it is desirable that the shaft in its middle area have a wall thickness as small as possible and in one or both end areas a smaller outside diameter and a much greater wall thickness.

In this shaft construction the wall thickness which can be achieved in the end area by the rotary swaging process cannot be arbitrarily increased, but depends on the outside diameter and the wall thickness of the original pipe, and on the outside diameter of the end area of the shaft (material preservation or constant volume). If the end area is to have an especially large wall thickness, it is necessary for the initial material, i.e. the original pipe, to have a large enough wall thickness or a correspondingly large outside diameter. This can then lead to the wall thickness and/or the outside diameter of the original pipe having to be larger such that the wall thickness or outside diameter of the finished shaft in the middle area is larger than desired. As a result, the pipe not only needs the end areas to be worked by rotary swaging, but, in addition, the middle area must be reduced by sinking both in its outside diameter and also in its wall thickness.

Another problem often arises due to the fact that welded pipes cannot be produced with just any wall thickness or with just any ratio of wall thickness to outside diameter. Here the maximum ratio of wall thickness to outside diameter is roughly 1/7. If the pipe is to have an even greater wall thickness or a smaller outside diameter with the same wall thickness, this can no longer be achieved by simple bending of sheet metal or steel strip and subsequent welding of the pipe. In this case, first a pipe with a larger outside diameter and a smaller wall thickness must be produced, i.e. bent and welded, and must then undergo one or more drawing processes, by which the outside diameter and the wall thickness of the pipe is reduced. If several drawing processes are necessary to achieve the desired pipe, generally a heat treatment of the pipe is necessary between the individual drawing processes. By the additional working steps in the production of a pipe, for so-called "drawn" pipes, the price is much higher than for simply welded pipes. The additional cost for "drawn" pipes being up to 30%.

In the prior art, the production of the initially described rotationally symmetrical component from a pipe requires the following steps shown in FIGS. 1A-1D:

- Producing a welded pipe with an outside diameter $D_1$ and a wall thickness $d_1$,
- Producing a pipe with an outside diameter $D_2<D_1$ and a wall thickness $d_2<d_1$ by one or more drawing processes,
- Sinking an area, preferably the middle area, of the pipe so that in this area the pipe has an outside diameter $D_M<D_2$ and a wall thickness $d_M<d_1$, and
- Working of at least one area, preferably an end area, of the pipe by rotary swaging at room temperature so that in this area the pipe has an outside diameter $D_E<D_1$ and a wall thickness $d_E>d_2$.

SUMMARY OF THE INVENTION

Therefore, an object of the invention is to devise a process for producing a rotationally symmetrical component from a pipe, which process can be carried out as simply and thus as economically as possible.

This object is achieved first of all by essentially a process with the following process steps:

- Provide a pipe with a wall thickness which corresponds to the smallest wall thickness of the finished component,
- Partial heating at least one area of the pipe,
- Axial upsetting the heated area of the pipe and
- Radial forging the heated area of the pipe.

The process of the invention can be carried out more easily and thus more economically by using a pipe with a wall thickness which corresponds to the smallest wall thickness of the finished component as the initial starting material. Within the framework of this invention, only the wall thickness of an area of the component with a certain length is ever considered. If, for example, the edge of the component has a short shoulder which has a small wall thickness, this should not be understood as the smallest wall thickness of the component. Generally, the component will have its smallest wall thickness roughly in the middle area, however, the area of the smallest wall thickness need not be exactly in the middle of the component. In the process of the invention, the step of sinking of an area, especially the middle area of the pipe, which is generally necessary in the prior art, is eliminated. If the shaft to be produced from the pipe is to be the drive shaft of a motor vehicle, only the two end areas need be worked, but not the middle area. The material volume necessary for producing an end area with a large wall thickness, for which in the prior art a pipe with a greater wall thickness than the initial material is necessary, is made available in the production of the rotationally symmetrical component according to the process of the invention by axial upsetting of the heated area of the pipe.

It is particularly advantageous if a welded pipe, which has not been redrawn, is used as the pipe. In this way, as stated above, the production costs for the initial material, i.e. the pipe, can be significantly reduced. The process of the invention can be advantageously developed by carrying out axial upsetting and radial forging of the heated area of the pipe in a clamp, preferably in one step. When the pipe need not be re-clamped from one machine to another in the individual working steps, the production times are shorter for the rotationally symmetrical component; this likewise benefits production costs.

In one alternative process for producing a rotationally symmetrical component from a pipe, the process has the following process steps:

Providing a welded pipe which has not been redrawn and with a relatively large wall thickness and Working of at least one area of the pipe by means of rotary swaging at room temperature.

In the process according to the second embodiment of the invention, the production costs are reduced by using as the initial material a pipe which is simply welded, but which has not been redrawn. The material volume necessary to achieve an edge area of the pipe with a relatively large wall thickness is made available in this process by bending the pipe from sheet metal or steel strip with great thickness. Advantageously, in the process according to this second embodiment of the invention the wall thickness of the pipe corresponds to the smallest wall thickness of the finished component.

In addition, the invention relates to a rotationally symmetrical component, especially a hollow monoblock shaft, with an outside diameter which varies over the entire length of the component and/or a varying wall thickness, the component having been produced from a pipe with a constant outside diameter and a constant wall thickness according to the process of the invention.

In particular, there is a plurality of possibilities for embodying and developing the inventive process and the rotationally symmetrical component of the invention. In this regard, reference is made to the following detailed description of one embodiment in conjunction with the drawings.

DETAILED DESCRIPTION OF THE INVENTION

FIGS. 1A-1D schematically show the production sequence in the manufacture of a shaft 1 with an outside diameter D which varies over the entire length and a varying wall thickness d according to the process known from the prior art, proceeding from a pipe 2. Of the four production steps shown overall, the first two production steps (FIGS. 1A and 1B) relate to the production of the pipe 2, while the last two production steps (FIGS. 1C and 1D) relate to production of the shaft 1 from the pipe 2.

Figures 1A, 1B, 1C, 1D:
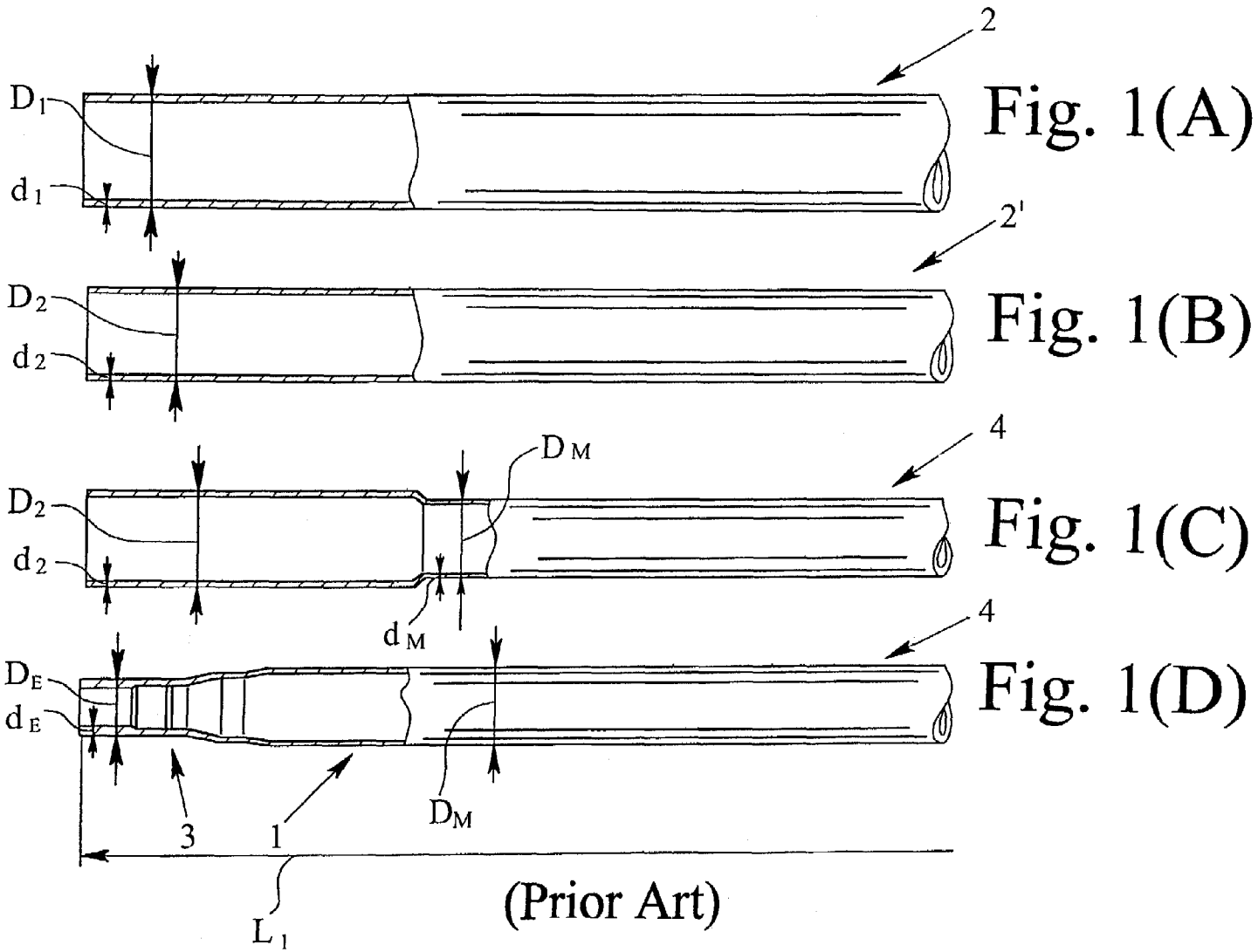
FIGS. 1A-1D illustrate a shaft, shown in different production stages in a process known in the prior art.

FIG. 1A shows a simply welded pipe 2 with an outside diameter $D_1$ and a wall thickness $d_1$. The wall thickness $d_1$ corresponds to the thickness of the sheet metal or steel strip from which the pipe 2 has been bent. FIG. 1B shows the pipe 2' after it has been drawn through a drawing die or drawing ring. By drawing the pipe 2, it has an outside diameter $D_2<D_1$ and a wall thickness $d_2<d_1$. This pipe 2' is dimensioned such that from the pipe a shaft 1 with an end area 3 with the desired outside diameter $D_E$ and the desired wall thickness $d_E$ can be produced by rotary swaging. At the same time, the pipe 2' however has an outside diameter $D_2$ and a wall thickness $d_2$ which are each larger than the outside diameter $D_M$ and the wall thickness $d_M$ of the middle area 4 of the shaft 1. Thus, in the production of the shaft 1 from the pipe 2', it is first necessary to sink the middle area 4 in order to achieve the desired outside diameter $D_M$ and the desired wall thickness $d_M$. For this reason a mandrel which is not shown here, with the corresponding outside diameter, is inserted into the pipe 2' and then the pipe 2' is worked by peening from the outside in its middle area 4 (compare FIG. 1C). Finally, for the shaft 1 the end area 3 is worked using the rotary swaging process so that the end area 3 has the desired outside diameter and wall thickness variation shown in FIG. 1D.

Producing a shaft 1 according to the above described process is especially complex and costly due to the fact that first the pipe 2' must be produced in several process steps, specifically besides the actual bending and welding in addition it must undergo one or more drawing processes and associated therewith in addition one or more heat treatments. Then to produce the shaft 1 from the pipe 2' both the middle area 4 and also the end area 3 must be worked, specifically the middle area 4 must be formed by means of sinking and the end area 3 by means of rotary swaging. The rotary swaging process at room temperature moreover has the disadvantage that due to result of strain hardening only relatively low degrees of working can be achieved.

The pipe 2 shown in FIGS. 1A-1D and the illustrated shaft 1 has for example the following outside diameter D and wall thickness d in the individual process steps:

$D_1$=60 mm, $d_1$=4.5 mm $D_2$=50 mm, $d_2$=4.0 mm $D_M$=40 mm, $d_M$=3.5 mm $D_E$=26 mm, $d_E$=8.0 mm

Figures 2A, 2B, 2C:
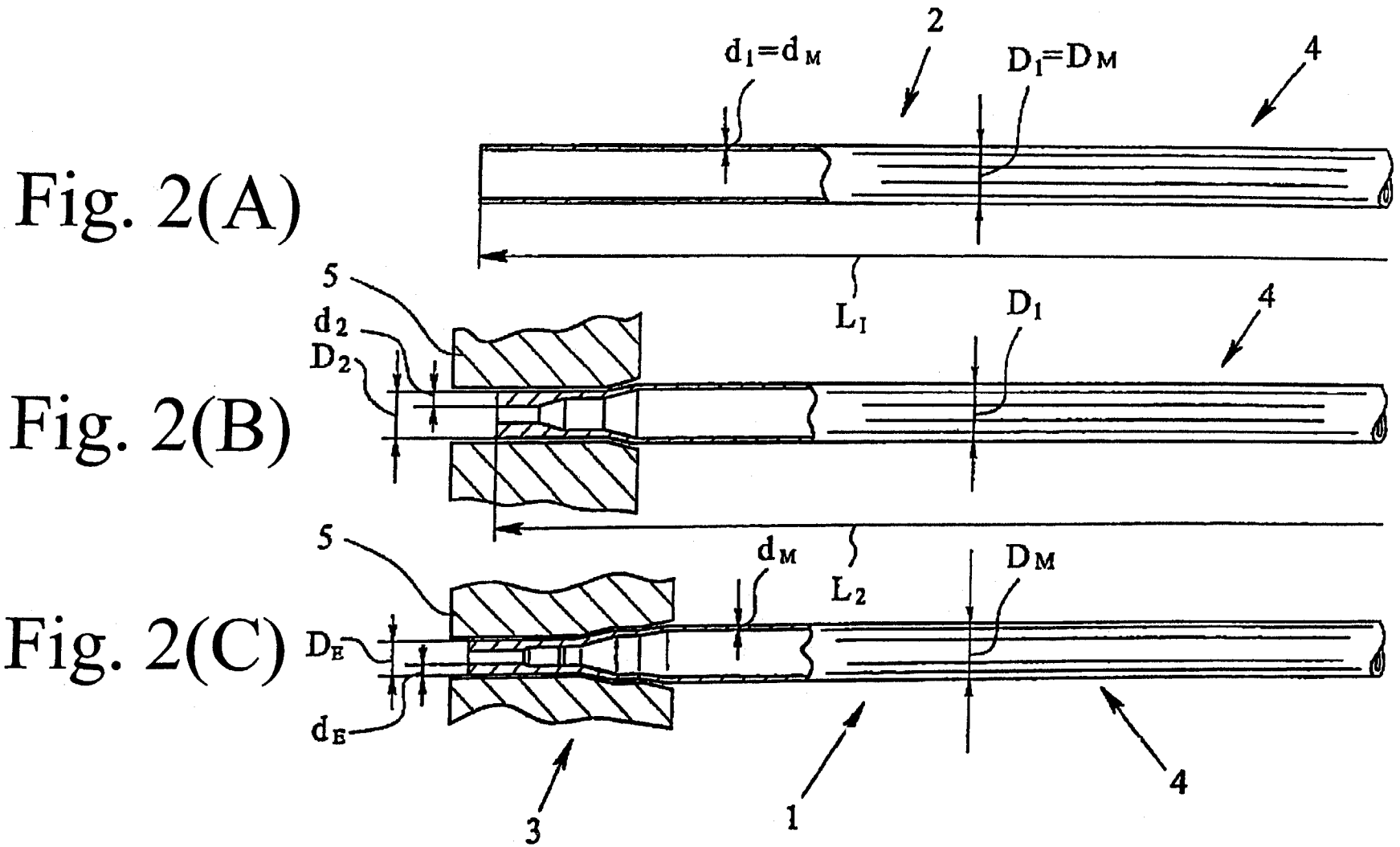
FIGS. 2A-2C illustrate a shaft, shown in different production stages in one preferred embodiment of the process of the invention.

FIGS. 2A-2C illustrate one embodiment of the process of the invention for producing a shaft 1 using three production steps. The first production step (FIG. 2A) corresponds to the first production step (FIG. 1A) in the process known from the prior art, it shows specifically a simply welded pipe 2 with an outside diameter $D_1$ and a wall thickness $d_1$. First of all, it is significant that the wall thickness $d_1$ of the pipe 2 corresponds to the wall thickness $d_M$ of the middle area 4 of the finished shaft 1. In addition, the outside diameter $D_1$ of the pipe corresponds to the outside diameter $D_M$ of the middle area 4 of the shaft 1 so that the middle area 4 of the pipe 2 or of the shaft 1 need not be worked.

Another advantage of the process of the invention is that a simple welded pipe 2, which has not been redrawn, can be used as the pipe 2. In this way, in the process of the invention one working step in the production of the pipe 2, specifically the drawing of the pipe 2, can be saved.

FIG. 2B illustrates that the pipe 2, which has been partially heated in the end area 3, is axially upset so that the pipe 2 has a total length $L_2<L_1$. The axial upsetting of the pipe 2 leads to an increased wall thickness in the end area 3.

In addition to axial upsetting, the heated area of the pipe 2, i.e. the end area 3, is worked by radial forging with a forging tool 5, by which the desired outside diameter DE is achieved. One multistage change in the outside diameter and wall thickness in the end area 3 is achieved by several radial forging processes. In the first intermediate step, the end area 3 has an outside diameter $D_2<D_1$.

To achieve the desired variation of the outside diameter in the end area 3, during the axial upsetting and radial forging of the heated area a mandrel is inserted into the pipe 2. By choosing the outside diameter of the mandrel, then the desired wall thickness $d_E$ of the shaft 1 is fixed. Because the pipe 2 is partially heated, considerably few or no strain hardening processes occur, by which a greater degree of working is possible.

The pipe 2 shown in FIGS. 2A-2C has, for example, the following outside diameters D and wall thicknesses d:

$D_1=D_M=40$ mm, $d_1=d_M=3.5$ mm $D_2=30$ mm, $d_2=8.0$ mm $D_E=26$ mm, $d_E=6.0$ mm.

While various embodiments in accordance with the present invention have been shown and described, it is understood that the invention is not limited thereto. These embodiments may be changed, modified and further applied by those skilled in the art.

Therefore, this invention is not limited to the details shown and described previously but also includes all such changes and modifications which are encompassed by the appended claims.

What is claimed is:

1. A process for producing a rotationally symmetrical component from a pipe, wherein the pipe initially has a constant outside diameter and a constant wall thickness and a length L1, and the rotationally symmetrical component has an outside diameter of at least one portion of the length of the component which deviates from the constant outside diameter of the pipe and a wall thickness which deviates from the constant wall thickness of the pipe and a length L2 that is smaller than length L1 at an intermediate step in the process, comprising the steps of:

selecting a pipe having a constant wall thickness and constant outer diameter extending from one end portion of the length of the pipe to a middle area of the pipe length, said selected pipe corresponding to the smallest wall thickness of the finished rotationally symmetrical component, partially heating at least the one end portion of the length of the pipe, axially upsetting the heated end portion of the pipe, and radially forging the heated end portion of the pipe to form the at least one end portion of the rotationally symmetrical component, wherein axial upsetting and radial forging of the heated end portion of the pipe takes place while the pipe is clamped and it is performed in one working step, wherein the length reduction of the rotationally symmetrical component from length L1 to length L2 is caused by the axial upsetting at an intermediate step in the process such that the constant wall thickness and constant outer diameter extends between the radially forged and axially upset end portion to the middle area of the pipe length spaced from the radially forged and axially upset end portion;

wherein a mandrel is located in the heated portion of the pipe during the axial upsetting and radial forging of the heated portion of the pipe to finally form the finished rotationally symmetrical component such that the constant wall thickness and constant outer diameter is maintained and extends between the radially forged and axially upset end portion to the middle area of the pipe length spaced from the radially forged and axially upset end portion.

2. The process as set forth in claim 1, wherein a welded pipe which has not been redrawn is used as the pipe.

3. The process as set forth in claim 1, wherein the pipe has an outside diameter which corresponds to the largest outside diameter of the rotationally symmetrical component.

* * * * *